US007518864B2

(12) United States Patent
Kimura

(10) Patent No.: US 7,518,864 B2
(45) Date of Patent: Apr. 14, 2009

(54) COOLING FAN AND IMAGE DISPLAY APPARATUS

(75) Inventor: Akira Kimura, Tokyo (JP)

(73) Assignee: Sony Corporation, Tokyo (JP)

( * ) Notice: Subject to any disclaimer, the term of this patent is extended or adjusted under 35 U.S.C. 154(b) by 250 days.

(21) Appl. No.: 11/271,682

(22) Filed: Nov. 11, 2005

(65) Prior Publication Data

US 2006/0199514 A1 Sep. 7, 2006

(30) Foreign Application Priority Data

Nov. 29, 2004 (JP) ..... P2004-344756

(51) Int. Cl.
*H05K 7/20* (2006.01)
*F21V 29/00* (2006.01)
*F04D 5/00* (2006.01)
*B63H 1/10* (2006.01)

(52) U.S. Cl. ..... 361/695; 165/104.33; 165/122; 362/294; 348/748; 415/53.1; 415/141; 415/53.2; 415/53.3; 416/108; 416/111; 416/112; 416/167; 416/198 R

(58) Field of Classification Search ..... 361/690, 361/694–695, 715; 165/80.3, 104.33, 121–122; 362/294; 313/11, 46; 345/60, 905; 348/748; 349/161; 415/53.1, 141, 53.2–53.3; 416/108–109, 416/111–112, 116, 167, 168 R, 198 R
See application file for complete search history.

(56) References Cited

U.S. PATENT DOCUMENTS 98,483 A * 1/1870 Fowler ..... 416/108
143,896 A * 10/1873 Volk ..... 416/108
154,571 A * 9/1874 Flower ..... 416/116
516,581 A * 3/1894 Wellner ..... 416/108
1,893,621 A * 1/1933 Hansen ..... 416/108
2,015,514 A * 9/1935 Ehrhart ..... 416/108
2,250,772 A * 7/1941 Mueller et al. ..... 416/108
3,268,010 A * 8/1966 Blickle et al. ..... 416/108
3,382,931 A * 5/1968 Dejussieu-Pontcarral et al. ..... 416/113
6,511,291 B2 * 1/2003 Koochingchai ..... 415/229
2004/0223299 A1 * 11/2004 Ghosh ..... 361/687
2006/0082271 A1 * 4/2006 Lee et al. ..... 313/35
2006/0164804 A1 * 7/2006 Kim et al. ..... 361/688

(Continued)

*Primary Examiner*—Jayprakash N Gandhi
*Assistant Examiner*—Zachary M Pape
(74) *Attorney, Agent, or Firm*—Sonnenschein Nath & Rosenthal LLP

(57) ABSTRACT

A cooling fan is provided that does not place limitations on the installation conditions for the fan, is capable of cooling a backlight unit of a display panel with high efficiency, and produces less noise during operation. Also provided is an image display apparatus equipped with the cooling fan. The cooling fan includes a fan rotator composed of a rotational shaft that is rotationally driven by a driving motor and two vanes that have parallel revolution shafts that rotate together with the rotational shaft, are freely rotatable on the shafts, face one another, and revolve around the rotational shafts and a vane angle control unit that implements control so that each vane has a maximum rotation angle when a revolution angle of the vanes is in a vicinity of a first revolution angle and each vane has a rotation angle of 0° when a revolution angle of the vane is in a vicinity of a second revolution angle that is perpendicular to the first revolution angle. By rotating the fan rotator, a wind in a single direction perpendicular to the rotational shaft is generated to cool a back light unit of a flat panel display, for example.

11 Claims, 12 Drawing Sheets

U.S. PATENT DOCUMENTS

2006/0290251 A1* 12/2006 Shives et al. ..... 313/46
2007/0103863 A1* 5/2007 Kim ..... 361/687
2007/0103864 A1* 5/2007 Kim ..... 361/687
2007/0103866 A1* 5/2007 Park ..... 361/695
2007/0103909 A1* 5/2007 Park ..... 362/294
2007/0212211 A1* 9/2007 Chiyoda et al. ..... 415/53.1

* cited by examiner

COOLING FAN AND IMAGE DISPLAY APPARATUS

CROSS REFERENCES TO RELATED APPLICATIONS

The present invention contains subject matter related to Japanese Patent Application JP 2004-344756 filed in the Japanese Patent Office on Nov. 29, 2004, the entire contents of which being incorporated herein by reference.

BACKGROUND OF THE INVENTION

1. Field of the Invention

The present invention relates to a cooling fan that can be favorably used in a flat panel display apparatus such as a thin-screen television and to an image display apparatus. In more detail, the present invention relates to a cooling fan for cooling a backlight unit that is a high-temperature region in a flat panel display apparatus, the cooling fan being especially capable of uniformly cooling the backlight unit of a large flat panel display apparatus with high efficiency and operating more quietly than conventional fans.

2. Description of the Related Art

Fans are conventionally used in a flat panel display apparatus such as a thin-screen television to cool the backlight that is both a light source for the display panel and also a high-temperature region. Propeller fans are superior for such use due to their high efficiency and quiet operation.

A display apparatus equipped with a propeller fan as the cooling fan for cooling a plasma display panel, for example, has been disclosed (see, for example, Patent Document 1).

In Patent Document 1, a plurality of ventilation holes and a cooling fan are provided at either end of a gap for allowing air to flow over a plasma display panel, at positions corresponding to gaps in a housing. Warm air that has been heated within the gap next to the plasma display panel is efficiently expelled from the housing by the cooling fan, thereby preventing the temperature inside the plasma display panel from rising.

Patent Document 1

Japanese Laid-Open Patent Publication No. H09-275534

However, there are the following problems for a television such as the plasma display panel mentioned above. Factors such as the apparatus design and installation conditions for the fan make it difficult to provide sufficient circular area for a propeller fan. In addition, although a reduction in the fan tip speed is desired in order to satisfy demands for extremely quiet operation, a larger circular area becomes necessary to achieve the required air flow, and therefore there arises a problem that the demand for quiet operation cannot be satisfied.

Aside from the propeller fans mentioned above, cross flow fans, sirocco fans and the like are also used. Since such fans generate airflows in all directions of the rotating surfaces, there are the problems of poor efficiency for use as cooling fans and a high noise level.

SUMMARY OF THE INVENTION

The present invention was conceived in order to solve the problems described above and the present invention aims to provide a cooling fan that does not limit the fan installation conditions, is capable of efficiently cooling a backlight unit of a display panel, and has a quieter operation, and to also provide an image display apparatus equipped with such cooling fan.

To solve the above problems and achieve the aim described above, a cooling fan of one embodiment of the present invention includes: a fan rotator composed of a rotational shaft that is rotationally driven by a driving source and at least two vanes that have parallel shafts that rotate together with the rotational shaft, are freely rotatable on the shafts, face one another, and revolve around the rotational shaft; and a vane angle control unit that implements control so that each vane has a maximum rotation angle when a revolution angle of the vane is in a vicinity of a predetermined first revolution angle and each vane has a rotation angle of 0° when the revolution angle of the vane is in a vicinity of a second revolution angle that is perpendicular to the first revolution angle, wherein a wind in a single direction perpendicular to the rotational shaft is generated by rotation of the fan rotator.

Also, in a cooling fan according to another embodiment, the vane angle control unit may include: a guide rod with a rotational center shaft that rotates eccentrically with respect to the rotational shaft; and the vanes that are supported by the guide rod and revolve.

Also, in a cooling fan according to another embodiment, a center of gravity of the guide rod may be caused to coincide with the rotational center shaft.

Also, in a cooling fan according to another embodiment, lengths of the vanes may be divided in a direction of the rotational shaft.

Also, in a cooling fan according to another embodiment, lengths of the vanes may be divided in a direction of the rotational shaft, and the vane angle control unit may be provided on the divided vanes.

Also, in a cooling fan according to another embodiment, a cross-sectional form of the vanes may be such that when each vane has a rotation angle of 0°, a center of the cross-sectional form substantially matches an arc centered on a center of revolution.

An image display apparatus according to another embodiment includes a flat panel display, a driving circuit that has an image displayed on the flat panel display, and a cooling fan that cools the flat panel display, the cooling fan including: a fan rotator composed of a rotational shaft that is rotationally driven by a driving source and at least two vanes that have parallel shafts that rotate together with the rotational shaft, are freely rotatable on the shafts, face one another, and revolve around the rotational shaft; and a vane angle control unit that implements control so that each vane has a maximum rotation angle when a revolution angle of a vane is in a vicinity of a predetermined first revolution angle and each vane has a rotation angle of 0° when the revolution angle of the vane is in a vicinity of a second revolution angle that is perpendicular to the first revolution angle, wherein the entire flat panel display is cooled by generating a wind in a single direction perpendicular to the rotational shaft by rotation of the fan rotator and by blowing a film of air onto the flat panel display.

Also, in an image display apparatus according to another embodiment, the vane angle control unit may include: a guide rod with a rotational center shaft that rotates eccentrically with respect to the rotational shaft; and the vanes that are supported by the guide rod and revolve.

Also, in an image display apparatus according to another embodiment, a center of gravity of the guide rod may be caused to coincide with the rotational center shaft.

Also, in an image display apparatus according to another embodiment, lengths of the vanes may be divided in a direction of the rotational shaft.

Also, in an image display apparatus according to another embodiment, lengths of the vanes may be divided in a direction of the rotational shaft, and the vane angle control unit may be provided on the divided vanes.

Also, in an image display apparatus according to another embodiment, a cross-sectional form of the vanes may be such that when each vane has a rotation angle of 0°, a center of the cross-sectional form substantially matches an arc centered on a center of revolution.

Additionally, it is possible to generate a fine wind in the form of a film in a direction perpendicular to the rotational shaft so that high efficiency and quiet operation can be expected with a fan that uses lift in the same way as a propeller fan.

Also, by using a simple construction, it is possible to generate a fine wind in the form of a film in a direction perpendicular to the rotational shaft.

Also, it is possible to remove vibration components during eccentric rotation of the guide rod, and noise that accompanies the vibration can also be avoided.

Also, even if the torsional strength of the vanes themselves transmits the change in angle of the substrate, twisting of the vane angle at the vane front ends can be eliminated. In addition, it is possible to prevent deformation to the vanes due to centrifugal force calculated from the cross-sectional form, material strength, radius of rotation, and the like of the vanes.

Also, the critical rotational speed of the rotational shaft that is directly coupled to the driving motor can be raised.

Also, a stalled state can be avoided without the attack angle of the front tip part of the vanes receiving a minus lift. Also, stalling can be avoided by increasing the length of the vanes.

In addition, it is possible to generate a fine wind in the form of a film in a direction perpendicular to the rotational shaft so that a flat panel display can be effectively cooled.

DESCRIPTION OF THE PREFERRED EMBODIMENTS

Hereinafter, preferred embodiments of a cooling fan and an image display apparatus according to the present invention will now be described with reference to the attached drawings.

First, the concept behind the cooling fan will be described with reference to FIG. 1.

The cooling fan can generate an air flow in one direction perpendicular to a rotational shaft 1, and includes a plurality of parallel revolution shafts 2 that revolve as a single body around the rotational shaft 1. Vanes 3 are rotatably provided on the revolution shafts 2 and by rotationally driving the vanes 3 using the rotational shaft 1 in the clockwise direction shown by the arrow in FIG. 1, lift is generated by the rotated vanes 3 at predetermined revolution angles, thereby producing an airflow in one direction.

Figure 1:
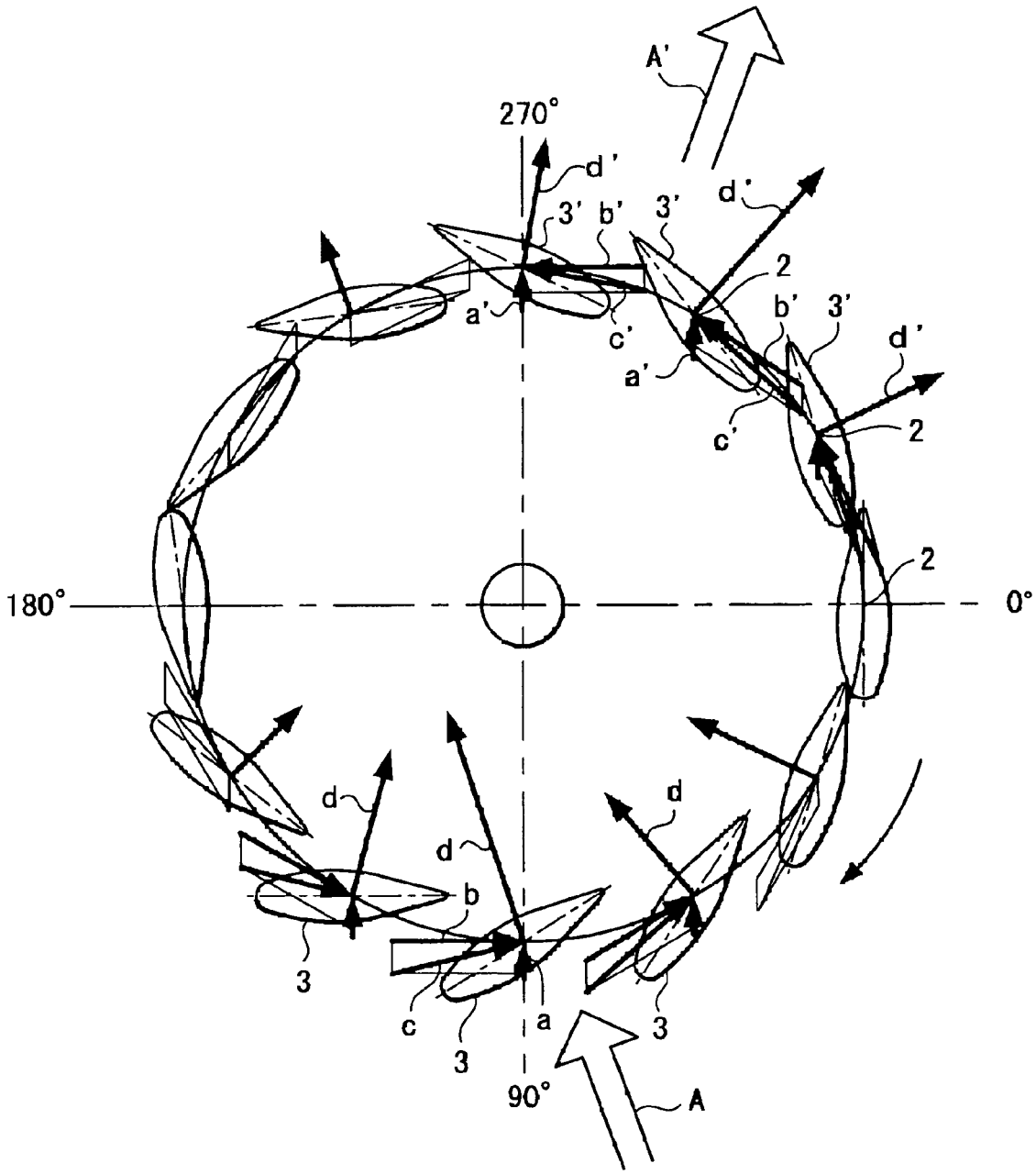
FIG. 1 is a schematic diagram showing a cooling fan according to the present invention.

Here, the lift produced by each vane 3 in FIG. 1 is defined by the expression given below.

$$\text{Lift}=Cl\cdot 0.5\cdot \rho v^2 \qquad \text{[Expression 1]}$$

where, Cl: inclination of vane

ρ: density v: volume

Here, since the vanes 3 are vanes of symmetrical constitution, $$Cl=a\cdot\alpha \qquad \text{[Expression 2]}$$

where a: coefficient

α: attack angle is true. The attack angle α shows the generated wind vector (a vector in an opposite direction to the lift) at the respective vane positions when, as, the fan tip speed: generated wind speed=3:1.

In this way, as shown in FIG. 1, a is the wind vector assumed to be generated, b is a wind vector received by each vane 3 as the vanes 3 revolve, c is a wind vector produced by combining the two wind vectors a and b, and d is a vector showing the magnitude and direction of the wind generated by an inverse vector to the lift generated in the vanes 3 by the wind vector c.

That is, as can be understood from the wind vectors shown in FIG. 1, when it is assumed that the vanes are rotationally driven in the clockwise direction shown by the arrows, for the vanes 3 positioned on the side with the rotational angle indicated as "90°", a wind vector with a magnitude and direction in the d direction is generated from an inverse vector to the lift generated by the vane 3 from the wind vector c. On the other hand, for the vanes 3' positioned on the side with the rotational angle indicated as "270°", a wind vector with a magnitude and direction in the d' direction, which represents a combination of the two wind vectors a' and b' as discussed above, is generated from an inverse vector to the lift generated by the vane 3' from the wind vector c'. That is, the air sucked in from the direction of the arrow A by rotation of the cooling fan can produce an air flow expelled and blown out in the direction of the arrow A'. It should be noted that for the vanes 3 positioned on the sides with the rotational angles indicated in FIG. 1 as "0°" and, "180°", the attack angle of the vanes that have been set at 0° to maximize the combined wind force is also 0°, and therefore a wind vector is not generated.

Next, a mechanism that controls the angles of the vanes 3 will be described as a means for realizing the concept described above.

Angular control over the vanes refers to control of the rotational angle of the vanes as the vanes 3 revolve. Here, "control" refers to control that continuously connects the maximum rotation angle of the vanes that appears in the peripheries of the revolution angles 90° and 270° and the rotation angle of 0° that appears in the peripheries of the revolution angles 0° and 180° and control over the maximum rotation angle itself of the vanes that appears in the peripheries of the revolution angles 90° and 270°. The former is referred to as "vane angle control" and the latter as "pitch control", with both types of control being referred to in general as "vane angle control".

Next, several means of a vane angle control mechanism will be described.

[Eccentric Circular Movement Guide Rod Method]

Figure 2:
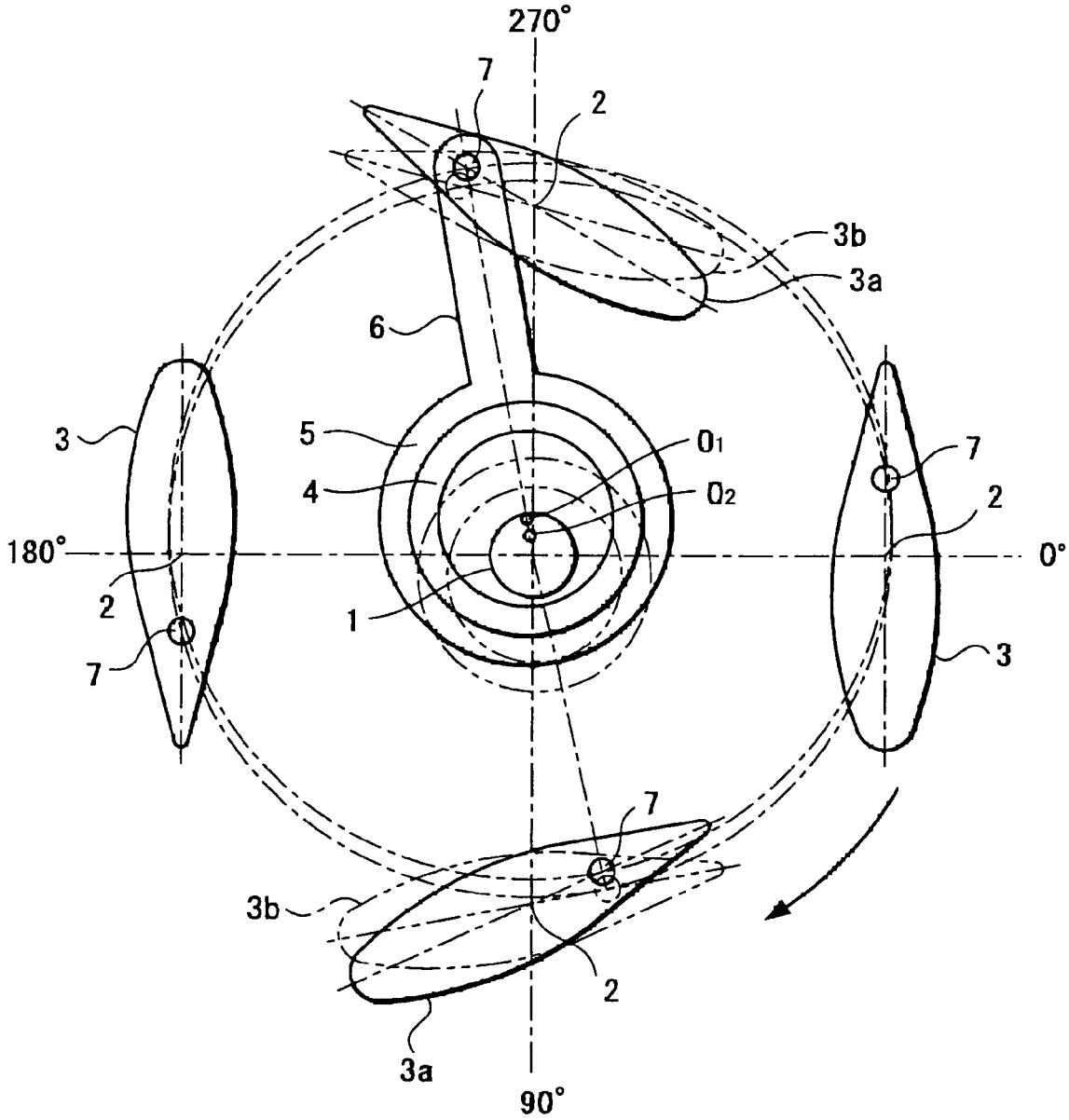
FIG. 2 is a principle drawing for a cooling fan that uses an eccentric circular movement guide rod method.

This method can be realized by a simple construction, and an image thereof is shown in FIG. 2. In FIG. 2, the rotational posture (i.e., angle) of a single vane 3 is shown when the vane 3 is positioned at the respective revolution angles of 0°, 90°, 180°, and 270°.

According to this method, a guide rod 5 is attached in an eccentric state to the rotational shaft 1 via a bearing 4, and an arm 6 that is a front end part of the guide rod 5 supports, using a shaft 7, a part of the vane 3 displaced from the revolution shaft 2 toward the rear of the vane 3. In FIG. 2, vanes 3a that are the most inclined show the vanes when the center of rotation of the guide rod 5 is positioned at O1. This is a base position for the vane angle control mechanism. Vanes 3*b* in FIG. 2 that have a different inclination show the inclinations of the vanes when pitch control has been implemented, with the center of rotation of the guide rod 5 being positioned at O2 when the vanes are inclined at the positions of the vanes 3*b* in FIG. 2.

The rotational angle of the vane 3*a* is the maximum rotational angle and is the angle that generates the most wind, while the rotational angle of the vane 3*b* is the angle that generates the least wind. By implementing pitch control between the maximum rotational angle of the vane 3*a* and the angular position of the vane 3*b*, the magnitude of the generated wind can be controlled.

As a means for causing a change between the maximum rotational angle of the vane 3*a* and the angular position of the vane 3*b*, although not illustrated, it is possible to linearly move the bearing 4 and the center of rotation of the guide rod 5 from O1 to O2 using a slide mechanism.

According to the above construction, although the center of rotation of the guide rod 5 is eccentric, the guide rod 5 merely rotates around the eccentric center of rotation, and vibration elements can be eliminated by making the center of gravity of the guide rod 5 match the center of the rotational shaft.

The pitch control described above can be easily realized by moving the bearing 4 through which the rotational shaft 1 passes and whose internal diameter is larger than the external diameter of the rotational shaft 1, as shown in FIG. 2. It should be noted that although the movement of the bearing 4 is shown as linear movement in FIG. 2, by moving the bearing 4 on a circular trajectory centered on a point P, it is possible to keep the attack angle of the vanes, for which the combined wind power is maximum at the angle 0°, always at the angle 0°.

[Vane Angle Guideway Method]

Figure 3:
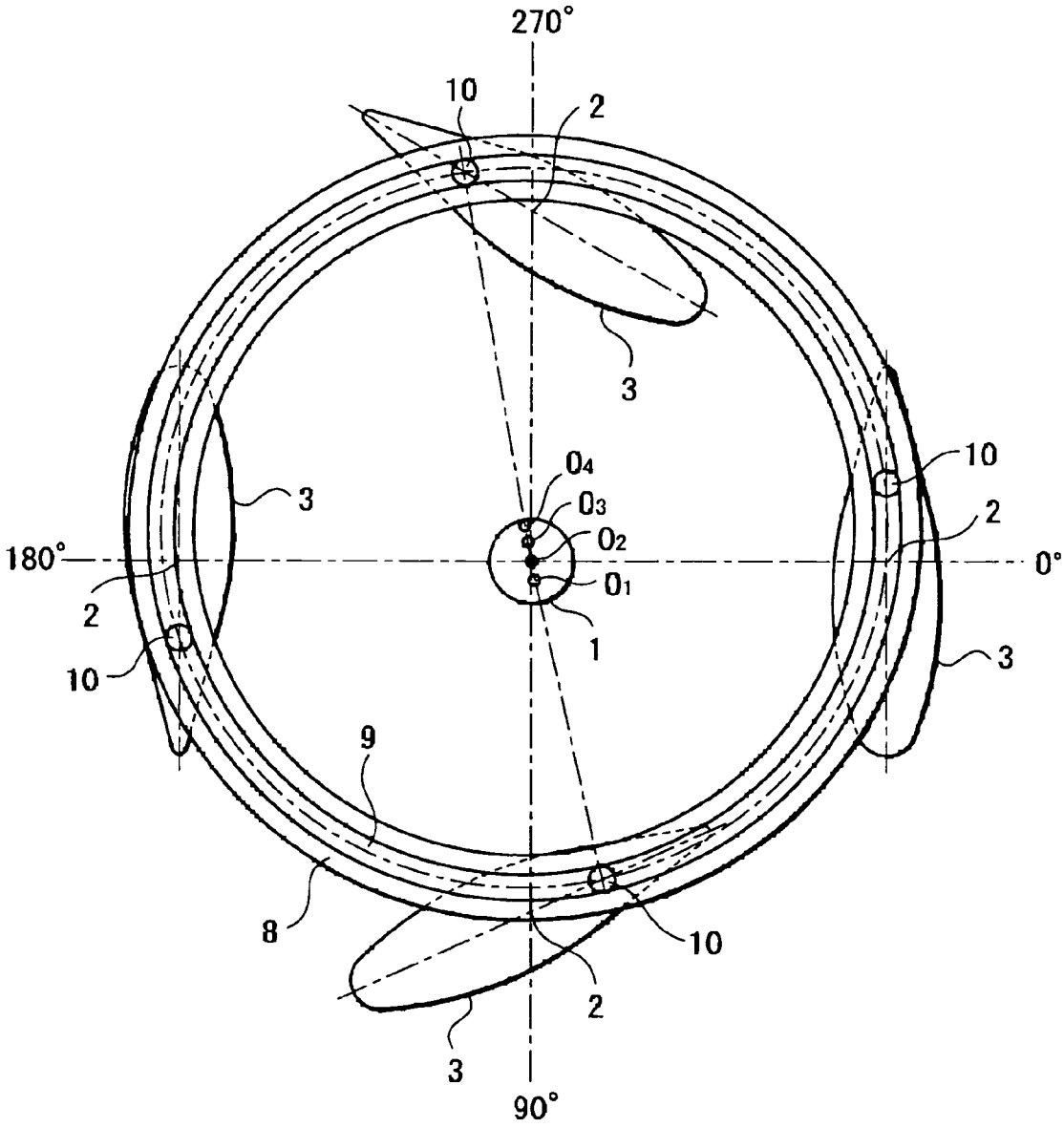
FIG. 3 is a principle diagram for a vane angle guideway method.

An image of a guideway method is shown in FIG. 3, and in the same way as in FIG. 2, the postures of a single vane as the vane revolves to positions at angles of 0°, 90°, 180°, and 270° are shown.

According to this method, a groove formed between two annular bodies 8 forms a guideway 9, with a cam follower 10 connected to each vane 3 engaging the guideway 9 and controlling the angle of the vane 3. It should be noted that although vanes that are subjected to pitch control are not shown in FIG. 3, pitch control over the vanes can be realized by moving the center of rotation O1, O2, O3 and O4 of the guideway 9 together with the annular bodies 8 in the same way as in the eccentric circular movement guide rod method described above.

In this example, since in principle the guideway 9 does not need to be perfectly round, it is possible to freely adjust the angle changing pattern of the vanes at specified eccentric positions. Also, although the structure that moves becomes large, pitch control can be carried out in the same way as in the eccentric circular movement guide rod method described above.

[Combination of the Guide Rod Method and the Guideway Method]

Figure 4:
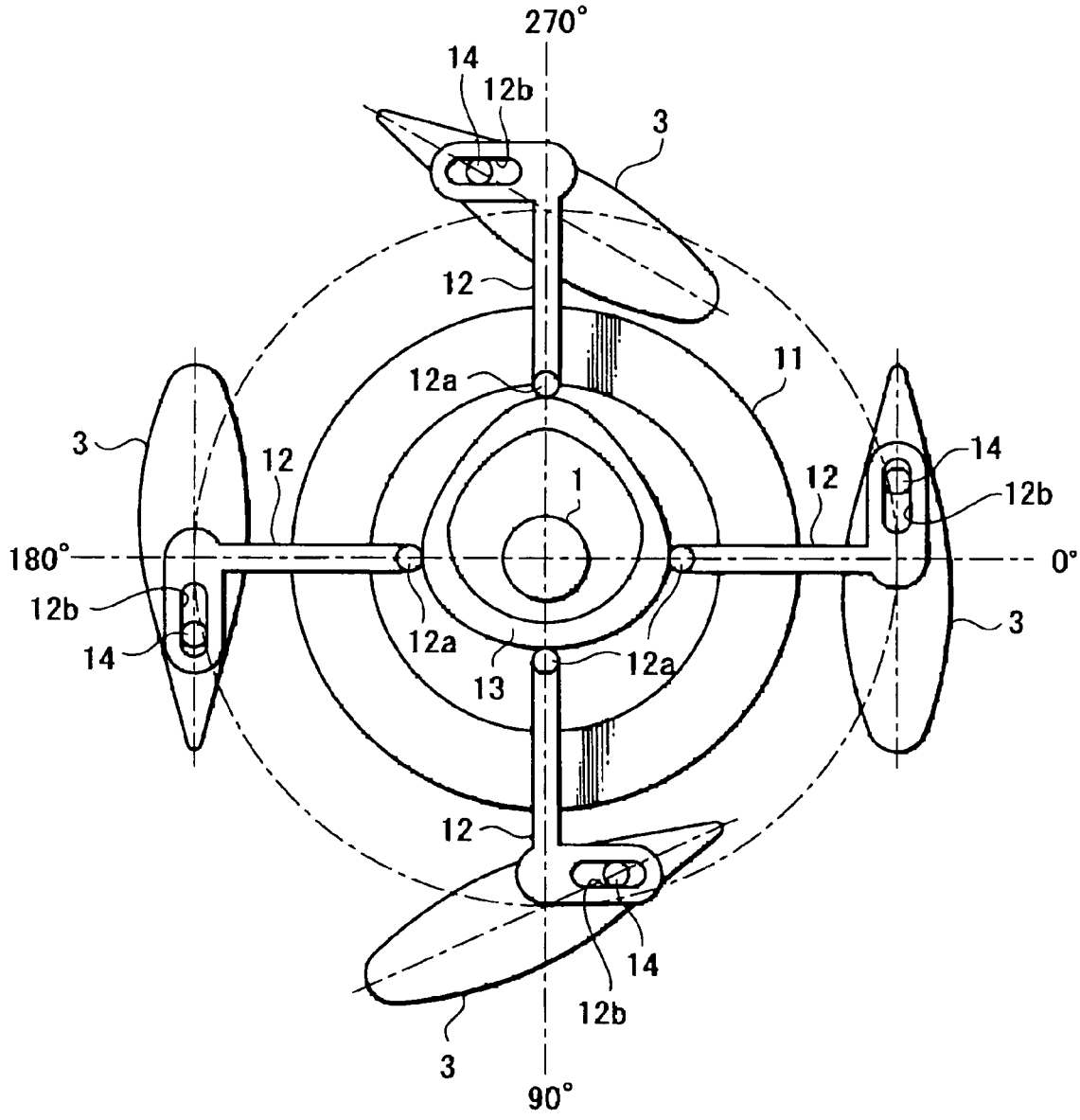
FIG. 4 is a principle diagram for a combined method for the guide rod method and the guideway method.

This combining method achieves both the ability to freely set the angle pattern of the guideway method and the low sliding speed on the guide surface and compactness of the part that is moved for pitch control of the eccentric circular movement guide rod method. A representation of this method is shown in FIG. 4, which like FIG. 2 shows the rotational posture (i.e., angle) of a single vane 3 when the vane 3 is positioned at the respective revolution angles of 0°, 90°, 180°, and 270°.

According to this method, an annular member 11 shaped like a donut that is concentric with and revolves together with the rotational shaft 1 is provided, levers 12 on which vanes 3 are supported can move only in a radial direction (a direction perpendicular to the shaft) on the annular member 11, and end parts 12*a* of the levers 12 always contact a surface of a cam member 13 in the form of a rounded triangle, for example, that is disposed inside the annular member 11 and does not revolve. One example of a contact means for having the lever 12 contact the cam member 13 is a method that uses a grooved cam, not shown to have a coil member press the lever 12 onto the annular member 13. In addition, each vane 3 is supported so that a shaft pin 14 provided on the vane 3 can move in a guide hole 12*b* formed in the lever 12. Pitch control of the vanes 3 can be realized by moving the cam member 13 up and down.

It should be noted that although not shown, this method differs to the eccentric circular movement guide rod method in that it is necessary to add a mechanism that cancels out the movement of the center of gravity of each rod due to the change in position from the center of rotation of the rod. As one example, it is possible to move a counterweight by using a rack and pinion or a loop belt.

Next, the cross-sectional form of the vanes will be described.

Figure 5:
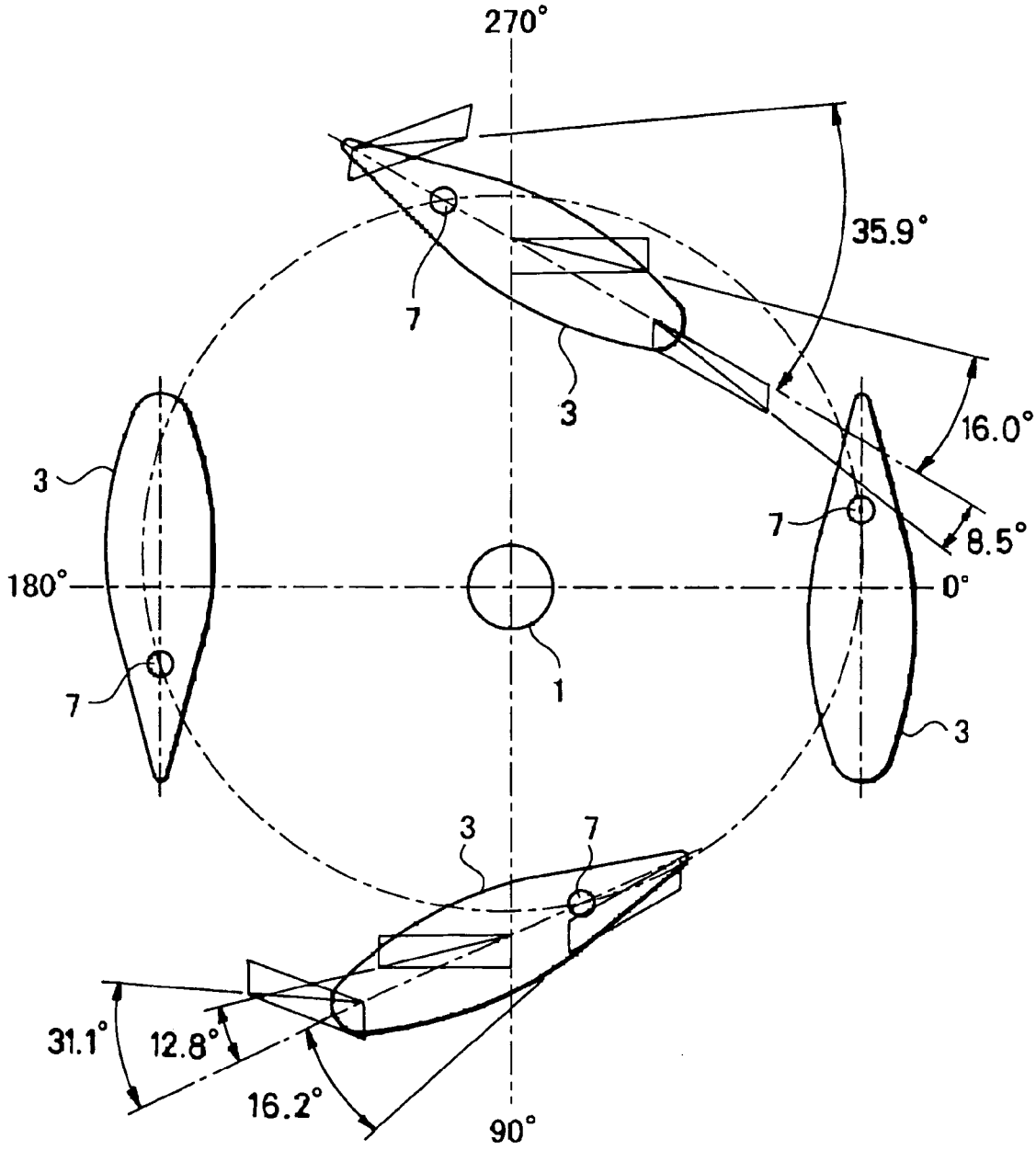
FIG. 5 is a diagram useful in explaining the problems with symmetrical vane shapes.

Although the cross-sectional form of the vanes is illustrated using a symmetrical vane shape as shown in FIG. 5, such vane shape has the problems described below.

[Problem 1]

When a speed vector and a wind vector are plotted at three positions, namely, the front end part, an intermediate part, and a rear end part, of each vane 3, the orientations of the respective combined vectors differ. That is, the attack angle above described in principle is merely the angle for a position near the center of rotation (pitch) of each vane. Here, from FIG. 5 it can be understood that for the vane at the revolution angle of 90°, the vane front end part is subjected to lift in the opposite direction due to the attack angle being minus, but the rear end part is in a stalled state with an attack angle of over 30°. For the vane at the revolution angle of 270° also, the vane front end part becomes stalled with an angle of 31°, and the rear end part is inclined by 16° in the opposite direction. This phenomenon becomes increasingly conspicuous as a value "vane width/radius of revolution" increases and has a large effect on a cooling fan.

[Problem 2]

Since the wind force is proportionate to a square of the vane speed, if the revolution radius of the vanes is small, it becomes desirable to raise the rotational speed. However, since centrifugal force is given by v2/r, the centrifugal force that acts on the vanes becomes larger in inverse proportion to the radius of revolution. The fan according to the present invention is characterized in that the vane length can be increased, but since the centrifugal force acts on the long vanes, the thickness of the vanes whose cube (i.e., third power) affects the vane strength has to be kept sufficiently high. It therefore becomes necessary to use large, thick vanes that have high air resistance or to increase the vane width in accordance with the vane thickness, which would make Problem 1 worse.

[Problem 3]

The cooling fan according to the present invention is used in a large domestic appliance subjected to limitations regarding form. Noise is often undesirable for such appliances, and therefore fans are often used with a reduced vane speed. The concept of "solidity ratio" (the ratio of the overall vane area to the rotational area of the vanes) exists in fields such as propeller research, and when raising the wind volume with respect to the speed of the vanes, it is necessary to raise the solidity ratio (i.e., to increase the overall vane area, that is to increase the number of vanes and/or increase the vane width). For the present invention, increasing the number of vanes is disadvantageous from a cost perspective, and while this makes it desirable to increase the vane width, this would make Problem 1 worse.

Figure 6:
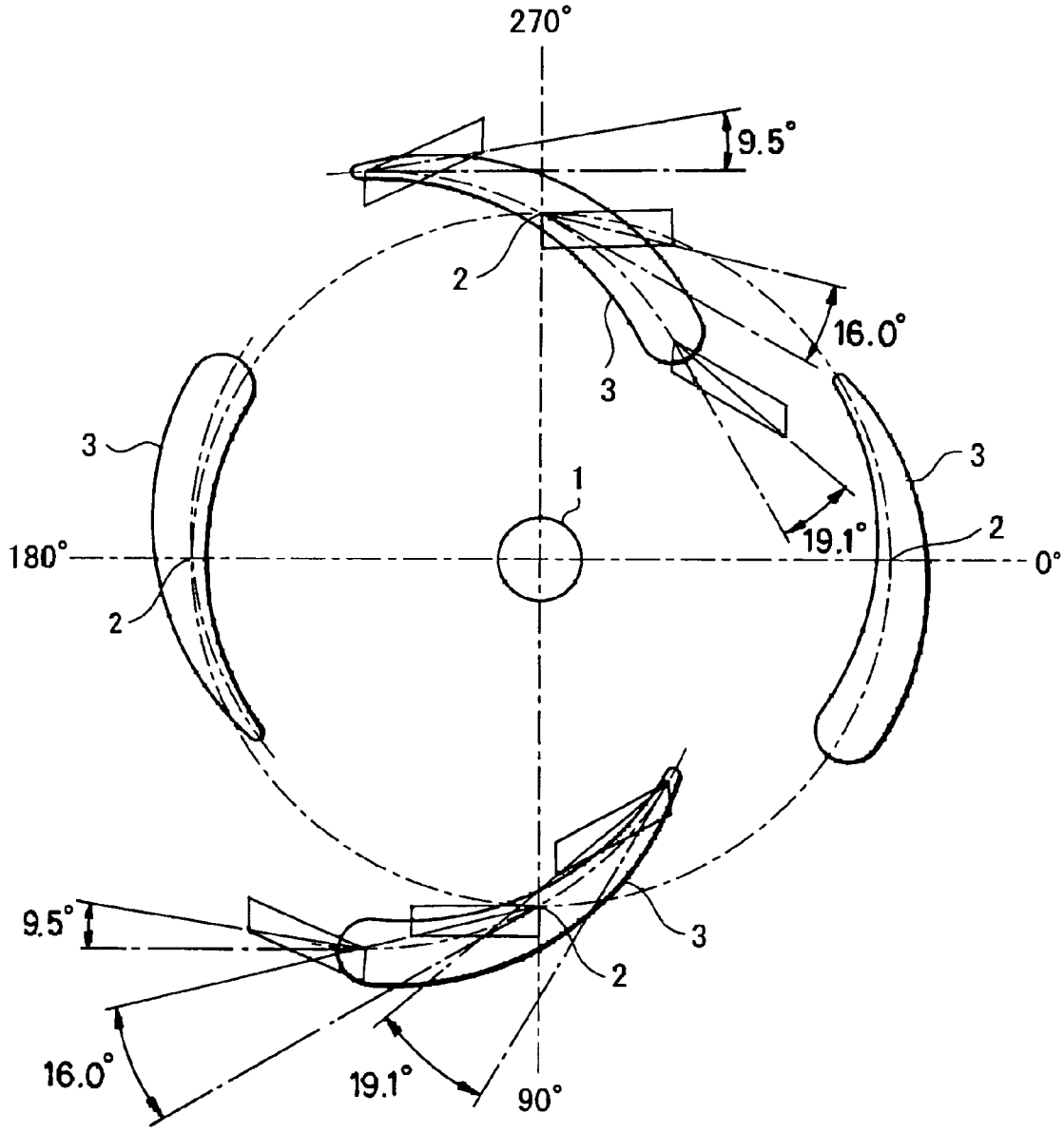
FIG. 6 is a diagram showing preferred vane shapes for the present invention.

The three problems are directly related as described above, and by using the cross-sectional form of the vanes shown in FIG. 6, it is possible to simultaneously solve the three problems. That is, when the rotation angle of a vane 3 is 0°, a center axis of the vane cross-section substantially matches an arc centered on the center of revolution of the vane 3. By using this form, since the respective differences in angle between (i) the orientations (i.e., a tangential direction for the center line of a vane) and the speed vectors are substantially the same for each of the front end parts, the intermediate parts, and the rear end parts of the vanes, the respective parts all have suitable attack angles. By doing so, Problem 1 and Problem 3 are simultaneously solved. Also, regarding Problem 2, even if the thickness of the vanes is reduced, the moment of inertia of section is increases when such form is used, and therefore Problem 2 can be largely solved.

Figure 7:
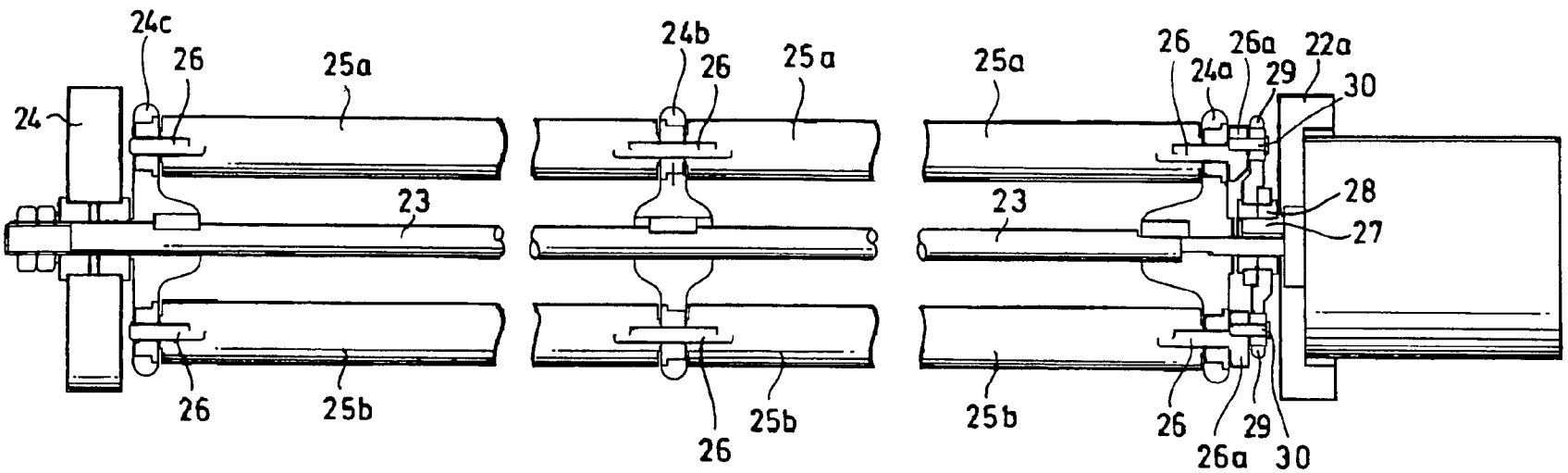
FIG. 7 is a front elevation of a cooling fan that uses the eccentric circular movement guide rod method and is provided for cooling a flat panel display.
Figure 8:
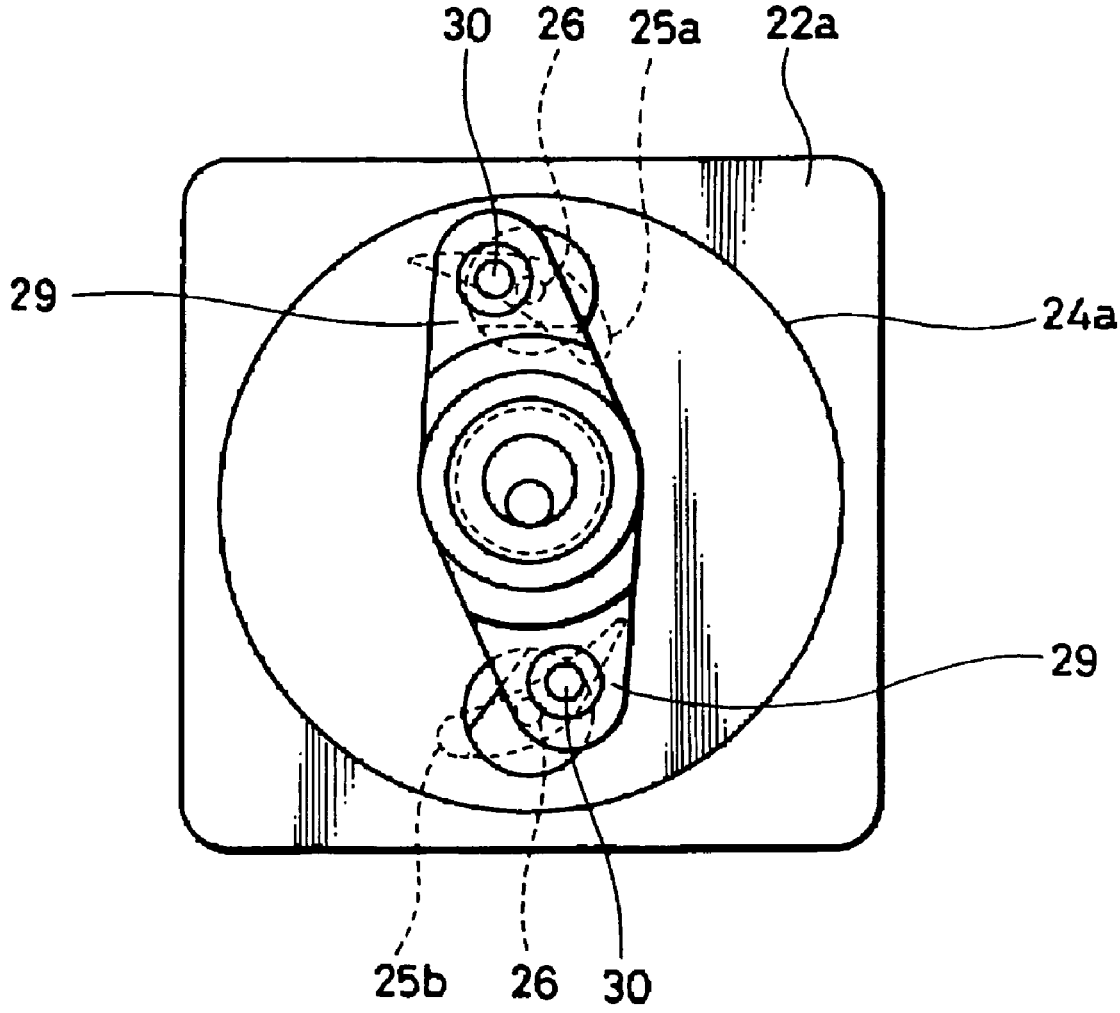
FIG. 8 is an enlarged side elevation of an eccentric circular movement guide rod mechanism of the cooling fan shown in FIG. 7.
Figure 9:
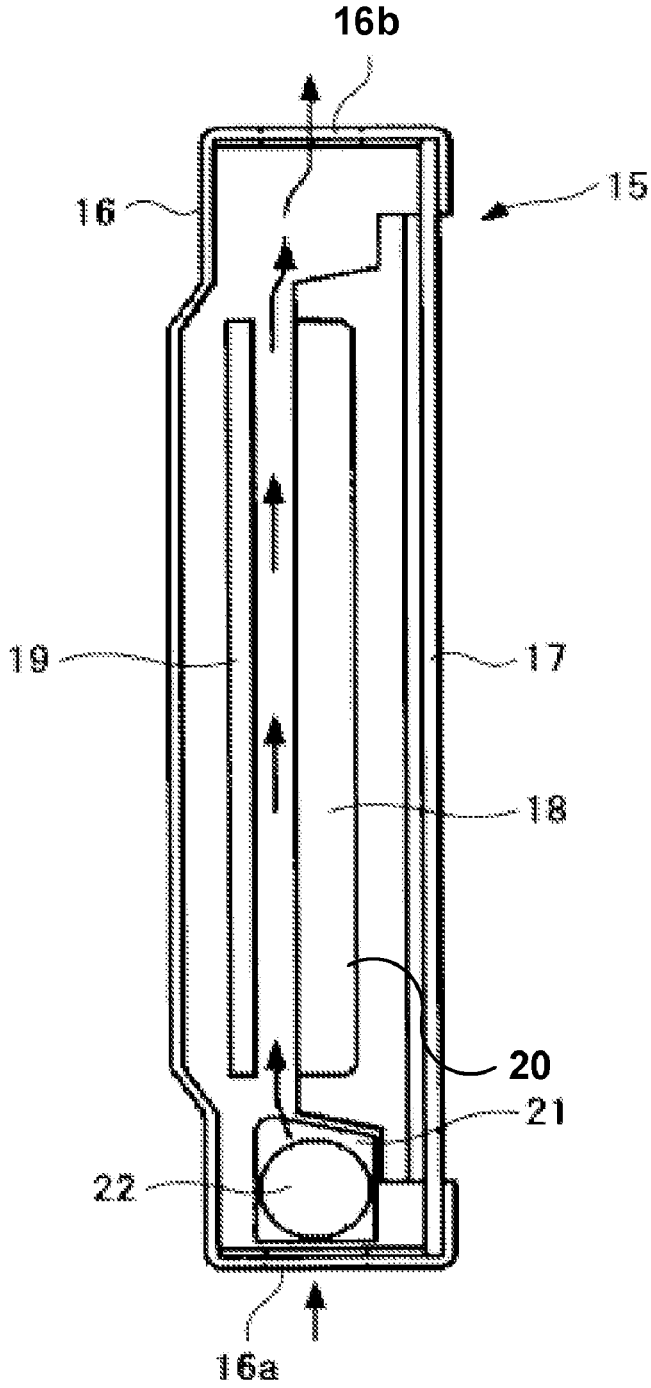
FIG. 9 is a side elevation of an internal construction showing the arrangement of a cooling fan with respect to a flat panel display.
Figure 10:
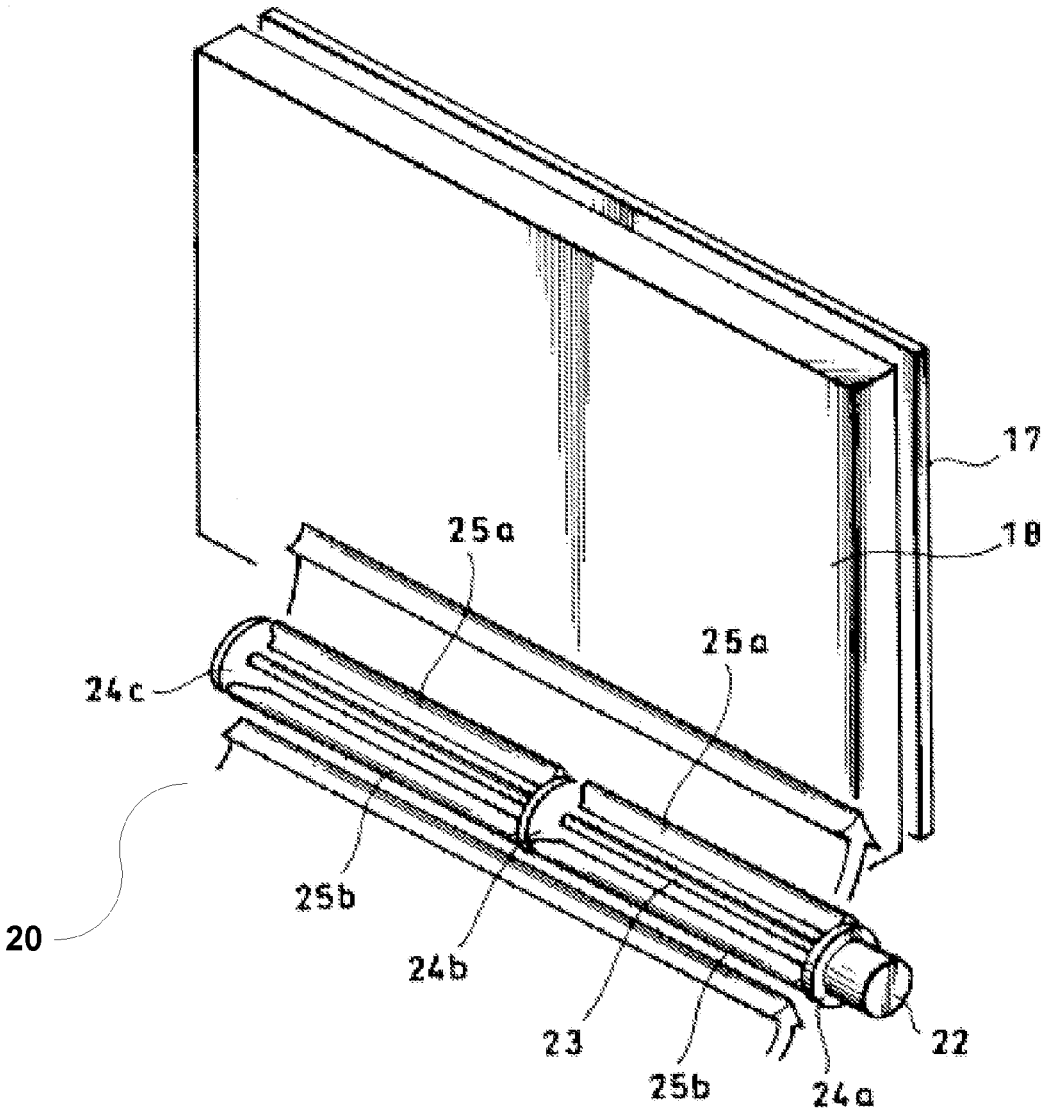
FIG. 10 is an external perspective view showing how the backlight of a liquid crystal display panel is cooled.

FIG. 7 is a front elevation showing an embodiment of a cooling fan that uses the eccentric circular movement guide rod method and is provided for cooling a flat panel display, FIG. 8 is an enlarged side elevation of an eccentric circular movement guide rod mechanism of the same fan, FIG. 9 is a side elevation of an internal construction showing the arrangement of a cooling fan with respect to a flat panel display, and FIG. 10 is an external perspective view showing how the backlight of a liquid crystal display panel is cooled. In the illustrated example, the cooling fan has two vanes.

In FIG. 9, the flat panel display whose overall structure is designated by reference numeral 15 has a liquid crystal panel 17 on a front surface of a display housing 16. A backlight unit 18 that is a light source of the liquid crystal panel 17 and is composed of LEDs or the like is disposed behind the liquid crystal panel 17. A driving circuit 19 for the flat panel display is disposed behind the backlight unit 18. A cooling fan 20 according to the present invention is installed inside a gap 21 that is around 20 mm square and 700 mm long that is produced at a lower part of the panel due to the construction of the flat panel display. By circulating a wind generated by rotationally driving the cooling fan 20 in the form of a "film" to the rear surface of the backlight unit 18, the entire backlight unit 18 is cooled uniformly. It should be noted that air is sucked into the cooling fan 20 from an air intake hole 16a formed in a base surface of the display housing 16 and air supplied to cool the backlight unit 18 is expelled from an expulsion hole 16*b* formed in an upper surface of the display housing 16.

Next, the construction of the cooling fan 20 will be described.

A driving motor 22 has an output shaft 23 whose length spans the entire length of the cooling fan 20, and a front end part of the output shaft 23 is rotatably supported by a support frame 24. Three vane support frames 24*a*, 24*b*, and 24*c* that rotate together with the output shaft 23 are provided at the driving motor 22 side, a front end side, and an intermediate part of the output shaft 23. Between the vane support frame 24*a* and the vane support frame 24*b*, vanes 25*a* and 25*b* are disposed at positions that are 180° apart, with the respective centers of both vanes 25*a* and 25*b* being rotatably supported by support pins 26. The vanes 25*a* and 25*b* are also disposed between the vane support frame 24*b* and the vane support frame 24*c*, with the respective centers of both vanes 25*a* and 25*b* being rotatably supported by the support pins 26. That is, the vanes 25*a* and 25*b* are both divided into two and the respective pieces are disposed in straight lines.

The eccentric circular movement guide rod mechanism is constructed as described below. An eccentric bearing 28 is supported on an outer circumference of an eccentric bearing 27 through which the output shaft 23 passes in an eccentric state from a flange 22*a* of the driving motor 22, with two guide rods 29 being supported in the eccentric direction of the eccentric bearing 28. Front end parts of the two guide rods 29 are supported by shaft pins 30 that protrude from eccentric positions on a flange 26*a* that is integrally molded with the support pins 26 of the vanes 25*a*, 25*b*.

With the eccentric circular movement guide rod mechanism constructed in this way, by driving the driving motor 22, the vanes 25*a* and 25*b* rotate together with the vane support frames 24*a*, 24*b*, and 24*c* about the center of the output shaft 23, with the vanes 25*a* and 25*b* revolving due to the rotational action of the guide rods 29 that eccentrically rotate via the eccentric bearing 28 so that the respective angles of the vanes 25*a* and 25*b* are controlled. For example, when one of the vanes 25*a* is at the revolution angles of 90° and 270°, the vane 25*a* has the maximum rotational angle, and when the other of the vanes 25*b* is at the revolution angles of 270° and 90°, the vane 25*b* has the maximum rotational angle. On the other hand, when one of the vanes 25*a* is at the revolution angles of 0° and 180°, the vane 25*a* has a rotational angle of 0°, and when the other of the vanes 25*b* is also at the revolution angles of 180° and 0°, the rotational angle of the vane 25*b* is 0°.

Figure 11:
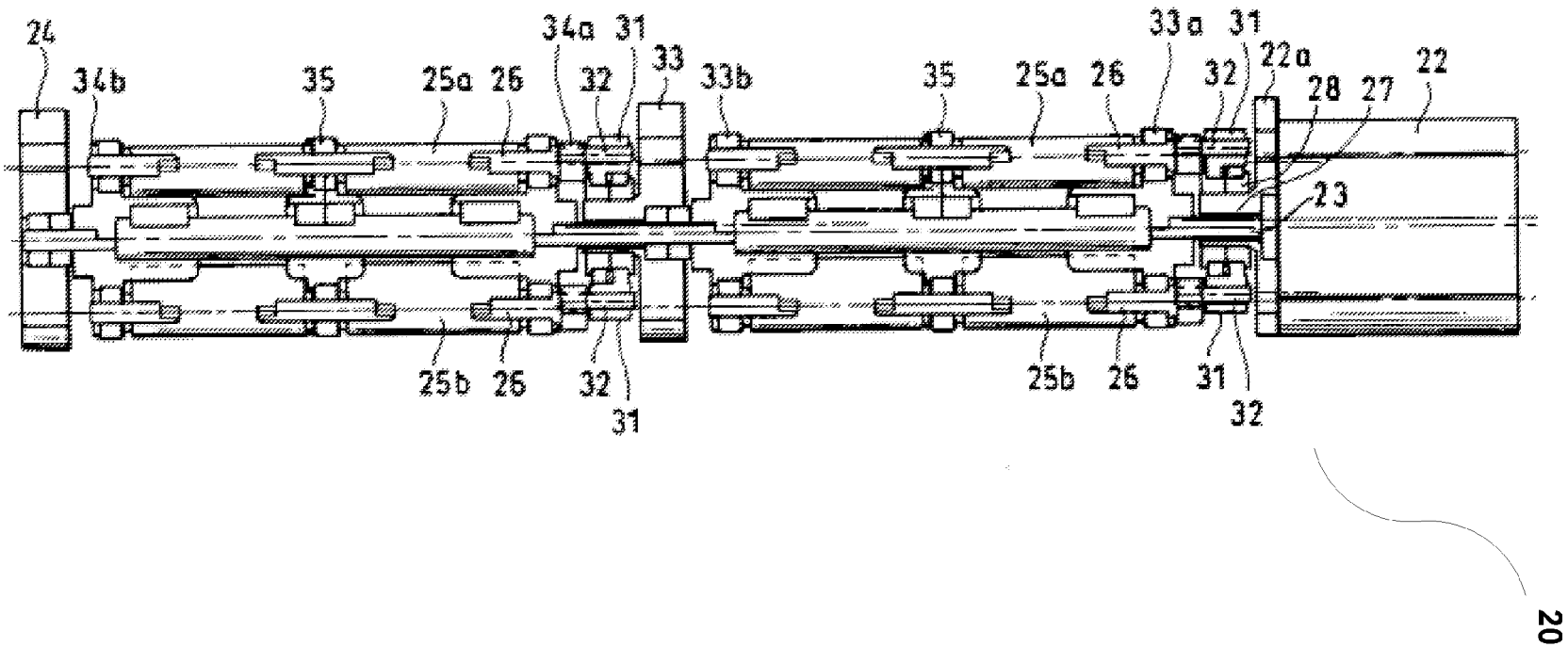
FIG. 11 is a front elevation of another embodiment of a cooling fan that uses the eccentric circular movement guide rod method.
Figure 12:
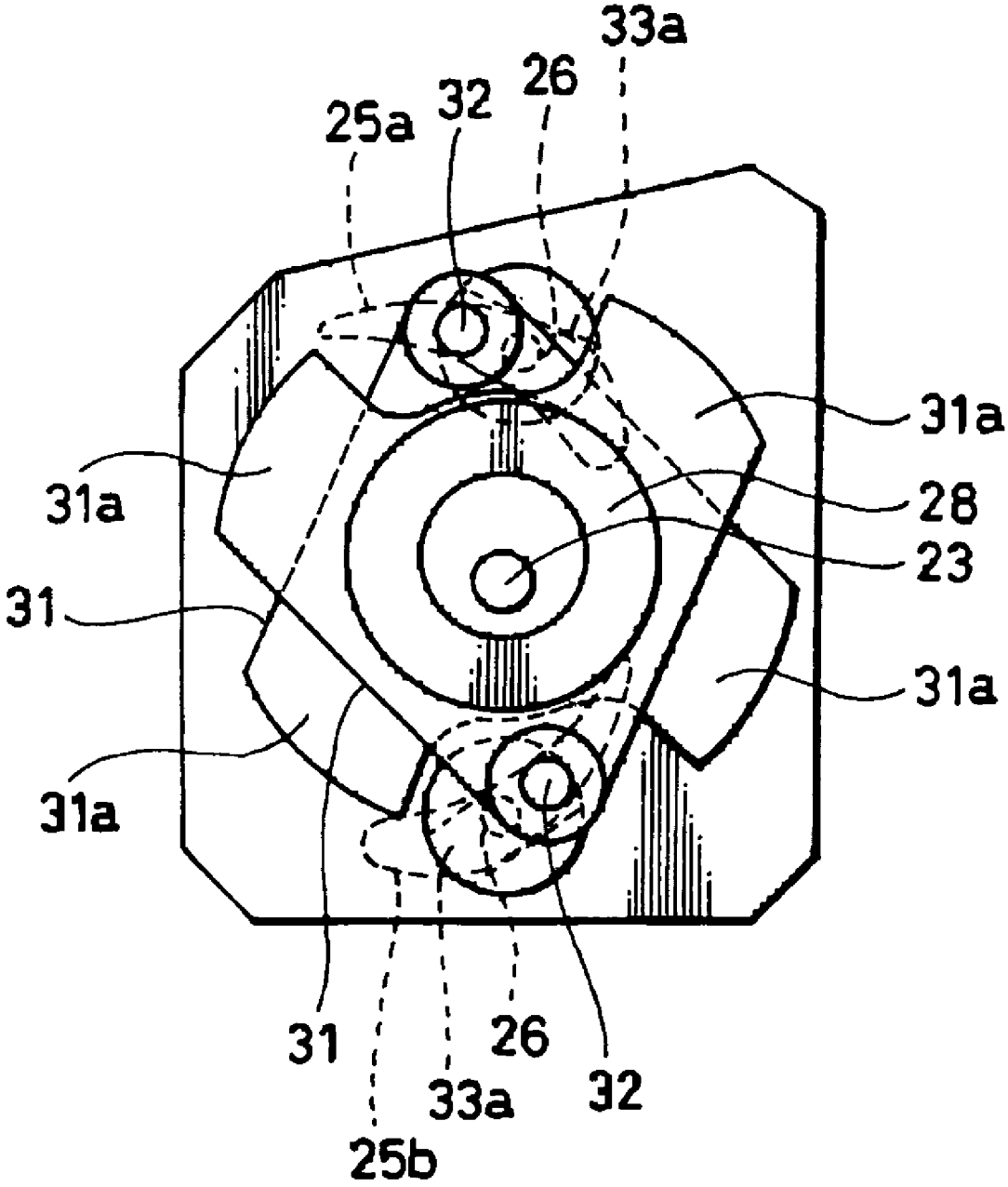
FIG. 12 is an enlarged side elevation of an eccentric circular movement guide rod mechanism of the cooling fan shown in FIG. 11.

FIG. 11 is a front elevation of another embodiment of a cooling fan that uses the eccentric circular movement guide rod method. FIG. 12 is an enlarged side elevation of an eccentric circular movement guide rod mechanism of the same cooling fan. Parts that are the same as the construction of the cooling fan shown in FIGS. 7 and 8 are designated by the same reference numerals and description thereof is omitted.

The vanes 25*a* and 25*b* of the cooling fan are divided with an intermediate support frame 33 as a boundary, one part of each vane 25*a* and 25*b* is supported by support frames 33*a* and 33*b*, and the other part of each vane 25*a* and 25*b* is supported by support frames 34*a* and 34*b*.

The eccentric circular movement guide rod mechanism according to the present embodiment has a different construction to that shown in FIG. 8. An eccentric bearing 28 is supported on an outer circumference of an eccentric bearing 27 through which the output shaft 23 passes in an eccentric state from a flange 22*a* of the driving motor 22, with two wheel plates 31 being supported on the eccentric bearing 28. The two wheel plates 31 are disposed in the opposite direction to the eccentric direction and are each provided with a balance weight 31*a*. Front end parts of the two wheel plates 31 are supported on shaft pins 32 that protrude eccentrically from a flange that is integrally molded with the support pins 26 of the vanes.

In the eccentric circular movement guide rod mechanism described above, by driving the driving motor 22, the vanes 25*a* and 25*b* rotate together with the support frames 33*a*, 33*b* and 34*a*, 34*b* about the output shaft 23, the vanes 25*a*, 25*b* revolve due to the rotating operation of the wheel plates 31 that rotate eccentrically via the eccentric bearing 28 and hence the angles of the vanes 25*a*, 25*b* are controlled.

The cooling fan described above is constructed so as to have two eccentric circular movement guide rod mechanisms in the length direction thereof. One eccentric circular movement guide rod mechanism is disposed on the driving motor 22 side and the other eccentric circular movement guide rod mechanism is disposed on the intermediate support frame 33 side. This structure is used to provide a bearing for the rotational shaft 1 from the outside at half the length to raise the critical rotational speed for the rotational shaft 1 that is directly coupled to the driving motor 22. In addition, the construction is designed to cope with the problem of a change in angle of the vanes being conveyed by the torsional strength of the vanes themselves, which would result in the angles of the vanes at the front end parts varying by an amount of twisting. Also, such constructions can be connected one after another, so that the length can be expanded.

Also, in the case of the cooling fan shown in FIG. 11, the vanes that have been divided into two are further divided into two by the support frames 35. This is in response to deformation of the vanes due to centrifugal force calculated from the cross-sectional form of the vanes, material hardness, specific gravity, rotational speed, rotational radius, and the like.

In addition, although the eccentric circular movement guide rod mechanisms have been shown in detail, in the illustrated example, vibration factors are eliminated by setting the respective centers of gravity of the guide rods, including the support pins that transmit the rotation of the vanes, at the respective centers of rotation of the rods.

As described above, the cooling fan according to the present invention can circulate air in the form of a rectangular film in a single direction that is perpendicular to the rotational shaft. Accordingly, since it is possible to increase the wind-producing area by increasing the length, the vane tip speed can be reduced. In addition, since sound energy is proportionate to the fifth power of the rotational speed, quieter operation is possible.

Also, in the same way as the propeller fan, high efficiency and quiet operation can be expected for a fan that utilizes lift. Also, even when the angle-changing pattern of the vanes is fixed, there are a variety of advantages as a wind generating fan. However, a greater effect can be obtained by utilizing the advantage that the level for changing the angle of the vanes can be easily controlled (i.e., having a variable pitch in a propeller fan).

As applications for a variable pitch fan, if the load fluctuates like the suction fan of a vacuum cleaner, when the load is high, quiet operation and efficiency can be pursued by reducing the change in angle, or for a fan in an air conditioner or the like with a variable speed, it is possible to change the angle in the pursuit of quiet operation and efficiency separately for each rotational speed.

The present invention is not limited to the embodiments described above and shown in the drawings, and can be subjected to a variety of modifications without departing from the scope of the invention.

The positions where the vanes have the maximum rotation angle or a rotation angle of 0° are not limited to the positions where the revolution angle is 90° or 270° and 0° or 180°, respectively, and such positions may be positions at predetermined revolution angles that are substantially perpendicular.

Although the cooling fan according to the present invention has been described by way of embodiments where there are two vanes, the present invention can be widely applied to cooling fans with three or more vanes.

Also, although the cooling fan has been described by way of embodiments where the cooling fan is used in a horizontal orientation, the present invention is not limited to this, and the cooling fan may be disposed in a vertical orientation.

It should be understood by those skilled in the art that various modifications, combinations, sub-combinations and alterations may occur depending on design requirements and other factors insofar as they are within the scope of the appended claims or the equivalents thereof.

What is claimed is:

1. A cooling fan comprising:

a fan rotator composed of a rotational shaft rotationally driven by a driving source; and at least two vanes each coupled to a separate guide rod, wherein, each guide rod rotates with the rotational shaft eccentrically around the rotational shaft center axis, each vane 1) freely rotates around the point where the guide rod is coupled to the vane, 2) faces another vane, and 3) revolves around the rotational shaft via the guide rod, each vane is configured such that the vane cross sectional center axis substantially matches an arc centered on the center of revolution of the vane at a second reference angle, the guide rod is effective to control the rotation angle of the vanes such that each vane has a maximum rotation angle when a revolution angle of the vane is in a vicinity of a predetermined first revolution angle and each vane has a rotation angle of 0° when the revolution angle of the vane is in a vicinity of the second revolution angle that is perpendicular to the first revolution angle, and a wind in a single direction perpendicular to the rotational shaft is generated by rotation of the fan rotator.

2. A cooling fan according to claim 1, wherein a center of gravity of the guide rod is caused to coincide with the center of the rotational shaft.

3. A cooling fan according to claim 1, wherein the lengths of the vanes are divided in a direction of the rotational shaft.

4. A cooling fan according to claim 1, wherein the lengths of the vanes are divided in a direction of the rotational shaft, and a vane angle control means is provided on the divided vanes.

5. A cooling fan according to claim 1, wherein a cross-sectional form of the vanes is such that when each vane has a rotation angle of 0°, a center of the cross-sectional form substantially matches an arc centered on a center of revolution.

6. An image display apparatus including a flat panel display, a driving circuit that has an image displayed on the flat panel display, and a cooling fan that cools the flat panel display, the cooling fan comprising:

a fan rotator composed of a rotational shaft that is rotationally driven by a driving source and at least two vanes that have parallel shafts that rotate together with the rotational shaft, are freely rotatable on the shafts, face one another, and revolve around the rotational shaft; and vane angle control means that implements control so that each vane has a maximum rotation angle when a revolution angle of a vane is in a vicinity of a predetermined first revolution angle and each vane has a rotation angle of 0° when the revolution angle of the vane is in a vicinity of a second revolution angle that is perpendicular to the first revolution angle, wherein the entire flat panel display is cooled by generating a wind in a single direction perpendicular to the rotational shaft by rotation of the fan rotator and by blowing a film of air onto the flat panel display.

7. An image display apparatus according to claim 6, wherein the vane angle control means includes:

a guide rod with a rotational center shaft that rotates eccentrically with respect to the rotational shaft; and the vanes that are supported by the guide rod and revolve.

8. An image display apparatus according to claim 7, wherein a center of gravity of the guide rod is caused to coincide with the rotational center shaft.

9. An image display apparatus according to claim 6, wherein lengths of the vanes are divided in a direction of the rotational shaft.

10. An image display apparatus according to claim 6, wherein lengths of the vanes are divided in a direction of the rotational shaft, and the vane angle control means is provided on the divided vanes.

11. An image display apparatus according to claim 6, wherein a cross-sectional form of the vanes is such that when each vane has a rotation angle of 0°, a center of the cross-sectional form substantially matches an arc centered on a center of revolution.

* * * * *